United States Patent [19]

Ernst

[11] Patent Number: 4,771,919

[45] Date of Patent: Sep. 20, 1988

[54] DISPENSING DEVICE FOR MULTIPLE COMPONENTS

[75] Inventor: Richard J. Ernst, Palatine, Ill.

[73] Assignee: Illinois Tool Works Inc., Chicago, Ill.

[21] Appl. No.: 113,491

[22] Filed: Oct. 28, 1987

[51] Int. Cl.[4] ..... B67D 5/60

[52] U.S. Cl. ..... 222/134; 222/145; 222/94; 222/288; 222/525; 222/506; 239/304; 239/343; 239/402; 239/414

[58] Field of Search ..... 222/94, 145, 134, 288, 222/520, 522, 524, 525, 492, 493, 506; 239/304, 343, 370, 402, 414, 416

[56] References Cited

U.S. PATENT DOCUMENTS

| | | | |
|---|---|---|---|
| 1,544,232 | 6/1925 | Huntoon . | |
| 1,601,818 | 10/1926 | Fusay . | |
| 2,218,092 | 10/1960 | Nitardy | 222/94 |
| 3,166,221 | 1/1965 | Nielsen . | |
| 3,195,784 | 7/1965 | Aaland | 222/288 |
| 3,197,071 | 7/1965 | Kuster . | |
| 3,200,995 | 8/1965 | Gangwisch . | |
| 3,206,074 | 9/1965 | Hoffmann . | |
| 3,248,025 | 4/1966 | Santore . | |
| 3,467,282 | 9/1969 | Schwartzman . | |
| 3,508,682 | 4/1970 | Hollis et al. . | |
| 3,741,441 | 6/1973 | Eberle . | |
| 3,834,596 | 9/1974 | Brady et al. . | |
| 3,850,346 | 11/1974 | Richardson et al. . | |
| 4,040,420 | 8/1977 | Speer . | |
| 4,046,288 | 9/1977 | Bergman . | |
| 4,261,481 | 4/1981 | Spee . | |
| 4,261,487 | 4/1981 | Seager . | |
| 4,432,469 | 2/1984 | Eble et al. | 222/134 |

FOREIGN PATENT DOCUMENTS

| | | | |
|---|---|---|---|
| 232733 | 8/1987 | European Pat. Off. | 222/145 |
| 806639 | 12/1936 | France | 222/520 |

*Primary Examiner*—H. Grant Skaggs

*Attorney, Agent, or Firm*—T. W. Buckman; D. I. Roche

[57] ABSTRACT

A dispensing device which includes two chambers, one for holding a resin and another for a hardener. Each chamber has an exit port formed in a neck which contains passageways leading to each of the chambers. The neck is equipped with external threads which mate with internal threads on a nozzle adjusting nut. A nozzle, which is carried by the nut can be moved from an open position to a closed position in which a portion of the nozzle's base closes the ports. A divider or tab projects from the neck at a location near and between the ports, and the nozzle has a slot to receive the divider. The divider serves to prevent mixing of the components until well after they exit the ports. The divider/slot arrangement further prevents mixing of the components by preventing relative rotation between the nozzle and the neck. Three separate sealing surfaces are formed on the base of the nozzle. One is cylindrical and seals against an O-ring carried by the neck. Two others are laterally disposed and are generally perpendicular to the axis of the device. The lateral sealing surfaces are on opposite sides of the slot and move into and out of sealing engagement with the ports. The nut operates as a valve to open and close the ports, and the nut acts as a retainer to non-rotatably hold the nozzle on the neck.

20 Claims, 2 Drawing Sheets

DISPENSING DEVICE FOR MULTIPLE COMPONENTS

BACKGROUND AND SUMMARY OF THE INVENTION

The present invention relates to the simultaneous dispensing of multiple component adhesive mixtures, and, in particular, to cartridge and nozzle combinations used in the application of two part adhesives in the field of building construction.

The use of such adhesives as a construction material naturally has both advantages and disadvantages. However, as with the continued use of any new material, the disadvantages are overcome with improved design, manufacture and technique of application. One disadvantage of using two component adhesive mixtures as a construction material has been the difficulty of conveniently packaging the components so that incremental amounts of adhesive can be used at irregular intervals. The need to mix precise amounts of component material together with the limited pot life has created the need for improved dispensing devices.

Another problem associated with the use of multi-component adhesives, and with any construction products is the rough handling of such products given by construction workers. Frequently, devices used in construction are thrown or fall from ladders or down uncarpeted stairs, are kicked, or are stepped on.

Therefore, it is an object of the present invention to provide a convenient quantity of unmixed adhesive which can be used in irregular quantities and at irregular intervals without damaging significant quantities of the unused adhesive components.

Another object is to provide a device which can be used to neatly store and deliver quantities of adhesive material in such a way that use of such material can be easily resumed after stopping.

Another object is to provide a multi-component dispensing device which will remain functional despite significantly rough handling.

These and other objects are achieved with a dispensing device which includes two chambers, one for holding a resin and another for a hardener. Each chamber has an exit port formed in a neck which contains passageways leading to each of the chambers. The neck is equipped with external threads which mate with internal threads on a nozzle adjusting nut. A nozzle, which is carried by the nut can be moved from an open position to a closed position in which a portion of the nozzle's base closes the ports. A divider or tab projects from the neck at a location near and between the ports, and the nozzle has a slot to receive the divider. The divider serves to prevent mixing of the components until well after they exit the ports. The divider/slot arrangement further prevents mixing of the components by preventing relative rotation between the nozzle and the neck. Three separate sealing surfaces are formed on the base of the nozzle. One is cylindrical and seals against an O-ring carried by the neck. Two others are laterally disposed and are generally perpendicular to the axis of the device. The lateral sealing surfaces are on opposite sides of the slot and move into and out of sealing engagement with the ports.

BRIEF DESCRIPTION OF THE DRAWINGS

A better understanding of the present invention may be gained by considering the following detailed description read in conjunction with the accompanying drawings in which.

DETAILED DESCRIPTION OF AN EMBODIMENT OF THE INVENTION

Figure 1:
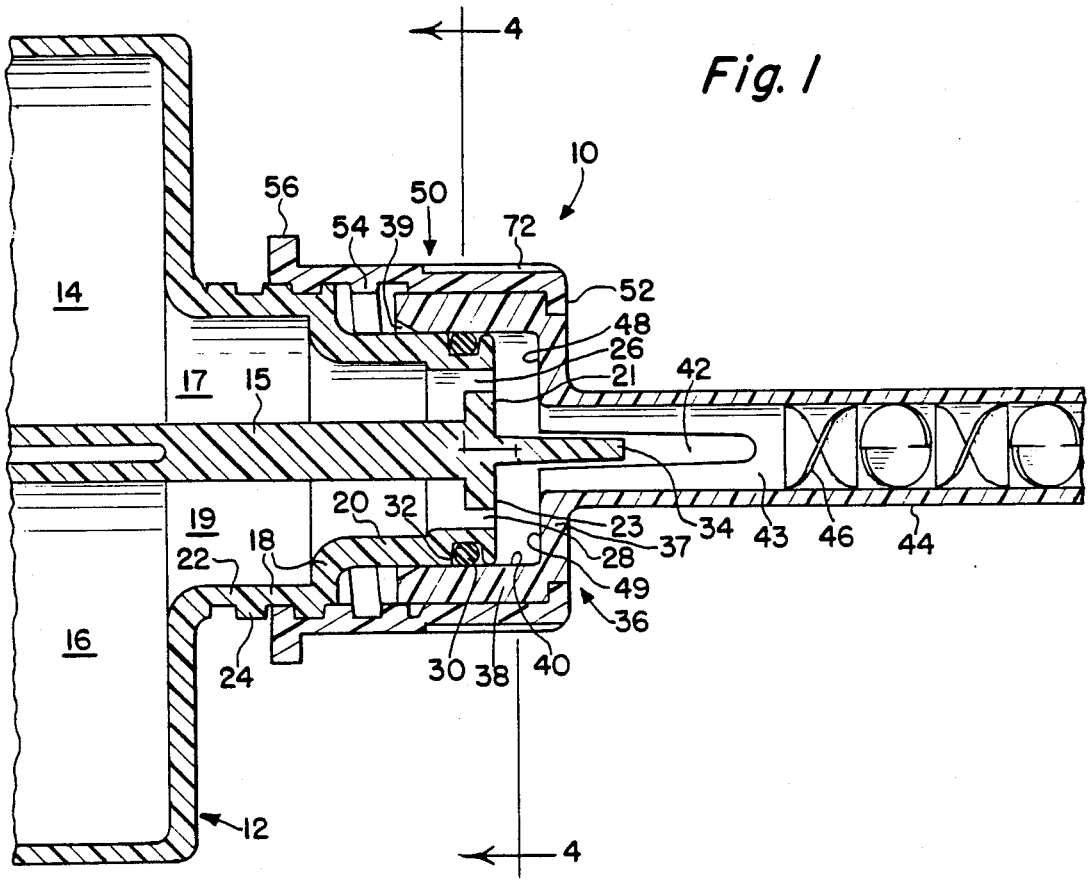
FIG. 1 is a cross-sectional view showing a device of the present invention in an open position.
Figure 2:
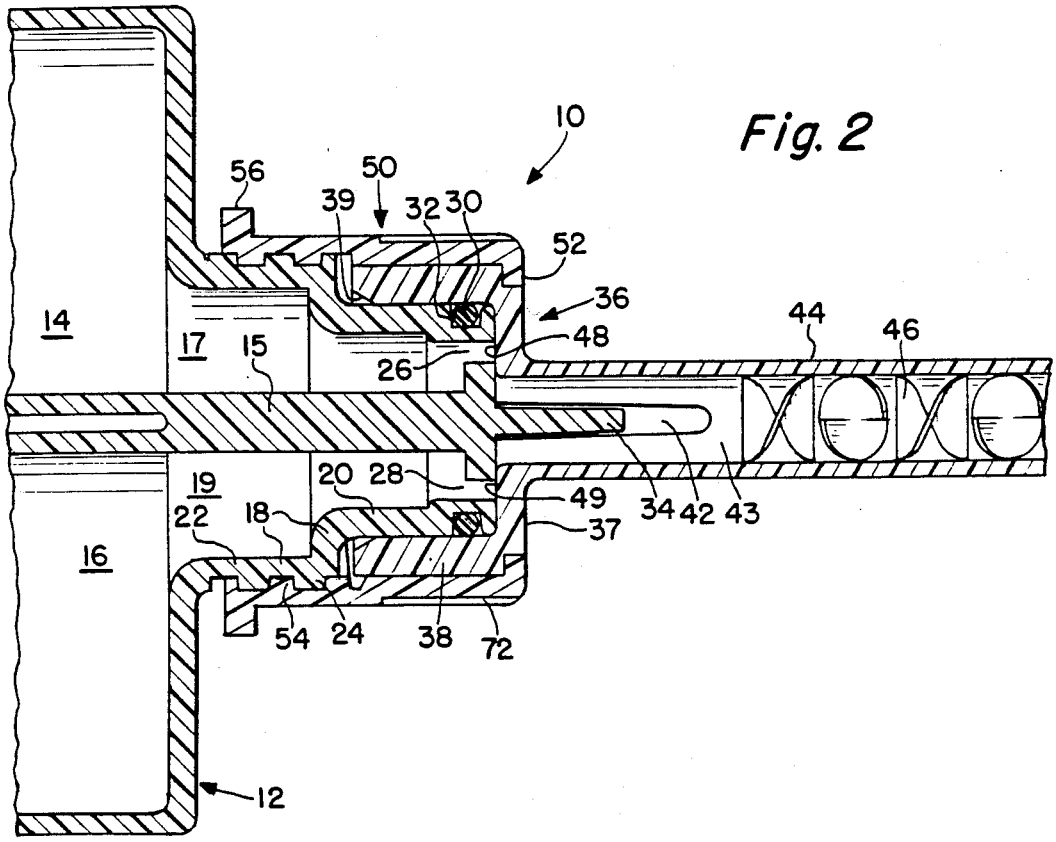
FIG. 2 is a cross-sectional view similar to FIG. 1 showing the same device in a closed position.

FIG. 1 shows a device made in accordance with the present invention. The device 10 is shown in the open position. The body 12 is comprised of a first chamber 14, a second chamber 16 and a neck 18. Ports 26 and 28 correspond to chambers 14 and 16 respectively, and each of the ports is in fluid communication with only its corresponding chamber. The passageways 17 and 19, which connect respective ports and chambers, are divided by a web 15.

The neck 18 has external threading 24 which is adapted to engage mating internal threading 54 formed on the adjusting nut 50. The threading 24 is formed on the lower part 22 of the neck. The upper part 20 of the neck 18 carries a seal 30, an O-ring, disposed in a circumferential groove 32. The passageways 17 and 19 are each larger in the lower part 22 of the neck and become narrower in the upper part 20. Finally, each of the passageways 17 and 19, merge with their respective ports 26 and 28, which are arcuate or crescent shaped.

A nozzle 36 is fitted over the upper part 20 of the neck 18. The nozzle 36 is comprised of a base 38 having a shoulder 37. The inside axial surface of the base is a smooth cylindrical surface 40 which engages the seal 30. A beveled edge 39 is formed at the lower end of the surface 40 to facilitate insertion of the upper part 20 of the neck 18 into the base 38. The nozzle 36 includes a pair of ribs 41, shown in FIG. 3, which snappingly engage an internally extending lip 52 on the upper end of the nut 50.

The nozzle 36 also includes a tube 44 extending from the shoulder 37. The tube 44 includes at its base a slot 42 for receiving the divider 34 formed on the end of the neck 18. At the end of the slot 42 a tortuous path for the components is formed by the insertion of a static mixer 46 in the tube 44.

The engagement between the adjusting nut 50 and the nozzle 36 is such that the two parts move together, but only in the axial direction. The nut is free to rotate relative to the nozzle 36, while the divider 34 engages the slot 42, which prevents rotational movement of the nozzle 36.

The flow of the components, or valving thereof, is controlled by operation of the adjusting nut 50. Rotation of the nut 50, and the resulting axial advancement thereof due to engagement with the threads 24 and 54, causes axial movement of the nozzle 36 because the lip 52 engages the base 38 of the nozzle when the nut is moved toward the chambers 14 and 16. When the nut 50 is moved toward the chambers 14 and 16, the sealing surfaces 48 and 49 cover the ports 26 and 28. The sealing surfaces 48 and 49 are generally perpendicular to the axis of the device and generally parallel to the end surfaces 21 and 23 on the neck 18. The sealing surfaces 48 and 49 are disposed on opposite sides of the slot 42.

Excessive axial movement of the nut 50, and thus the nozzle 36, away from the chambers 14 and 16 may be prevented by the inclusion of a stop or retaining plate on the dispensing tool (not shown) used to force components out of the chambers 14 and 16. The retaining plate or stop should have an opening large enough to allow movement of the nut 50 therethrough. This will allow rotation of the nut without removing the device 10 from the tool. The opening in the plate or stop should be small enough to prevent passage of the flange 56 through the opening. Interference between the flange 56 and the plate or stop acts as a limit, preventing complete removal of the nut and nozzle while the device 10 is in the tool. Such limit also controls the extent to which the ports 26 and 28 can be opened. From the foregoing it can be seen that the nut 50 serves two functions. It operates as a valve for opening and closing the ports 26 and 18. The nut 50 also operates as a mounting means for holding the non-rotating nozzle 36.

When the nut 50 is moved away from the chambers 14 and 16, the components stored in the chambers are free to flow out of the chambers through the passageways 17 and 19, and out of the ports 26 and 28. However, the components are kept from contacting each other until they have entered and passed a substantial distance into the tube 44. Isolation of the components until well after they have exited the ports is important for the reusability of the device. Mixing of or contact between the components at or near the ports would cause the ports to clog upon chemical reaction of the components.

Figure 3:
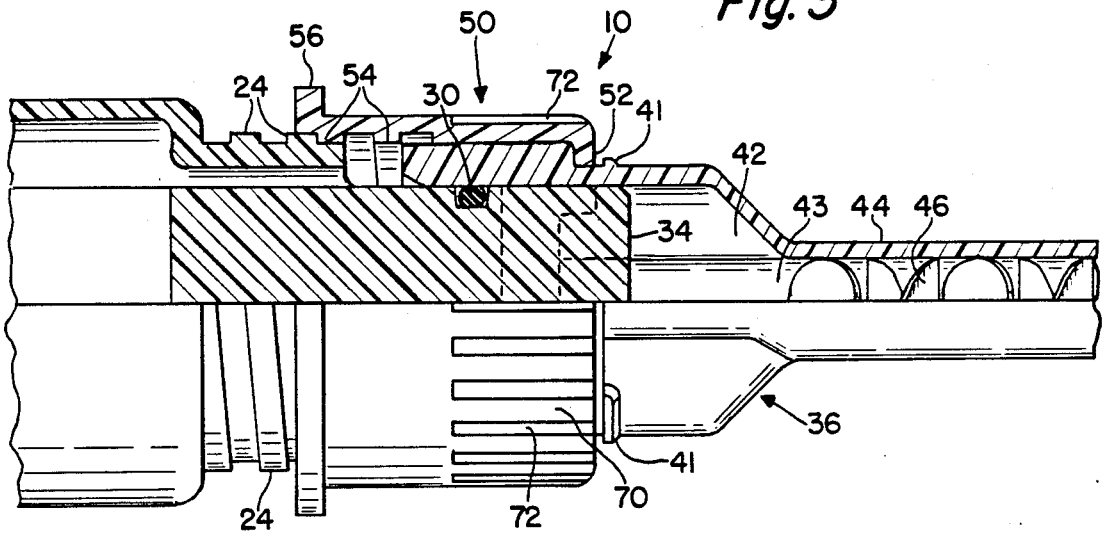
FIG. 3 is a partial sectional view of the device shown in FIG. 1, the sectional portion lying in a plane 90 The section portion of degrees from the plane corresponding to the FIG. 1 view.
Figure 4:
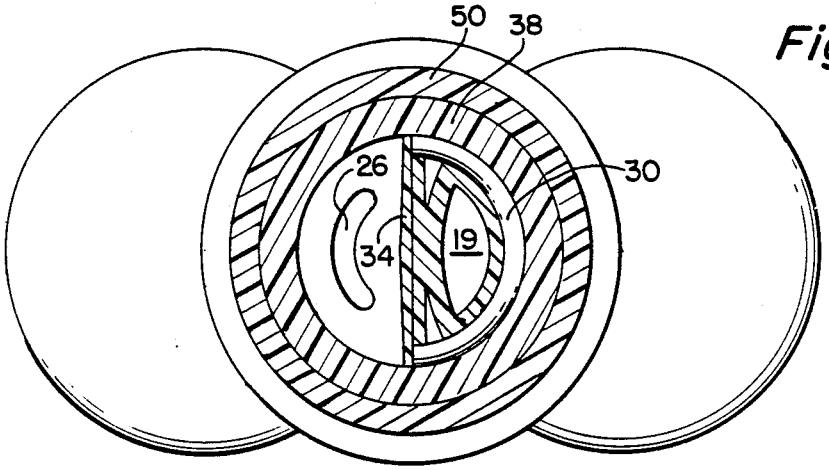
FIG. 4 is a sectional view taken along line 4—4 of FIG. 1.

FIGS. 3 and 4 show other aspects of the herein described embodiment. Splines 70 and grooves 72 facilitate rotation of the nut 50. The section portion of FIG. 3 clearly shows the full lateral extent of the divider 34 into the slot 42. FIG. 3 also shows the ribs 41 which snappingly retain the nozzle 36 and nut 50 in axial engagement, while allowing relative rotation thereof.

FIG. 4 shows sections of the device at two levels. One side of FIG. 4 shows that the port 26 is an arcuate opening, which is required because of the shape of the sealing surface 48 and its joining with the circular tube 44. The other side of FIG. 4 shows the shape of the passageway 19 at a location just behind the port 28.

Figure 5:
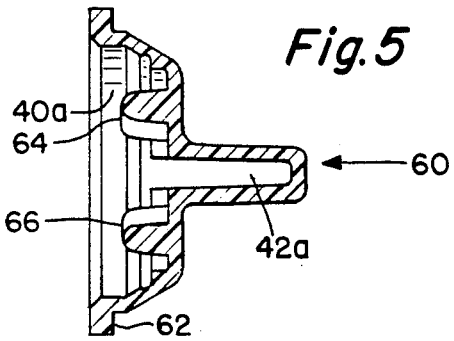
FIG. 5 is a sectional view of a cap usable with the device of the present invention.

The cap 60 shown in FIG. 5 is intended for use in situations where storage of partially emptied chambers is anticipated for extended periods of time. Short term storage can be achieved by simply moving the adjusting nut 50 to the closed position. However, such a procedure leaves the nozzle 36 projecting from the device. For more compact storage, the nozzle 36 can be removed by unthreading the nut 50, disengaging the nozzle from the nut, and replacing the nozzle with the cap 60. When the cap is snapped onto the neck 18, projections 64 and 66 extrude component material back through the ports 26 and 28, respectively keeping the ports sealed and clear. The sealing surface 40*a* is adapted to engage the seal 30 on the neck 18 for a positive seal during shipping and storage.

It should be noted that it is preferable to have a threaded connection between the adjusting nut 50 and the neck 18. Such a connection provides a firm attachment between the parts, which is important in helping to withstand the rough handling generally given to tools and other articles used in construction. However, it may be possible to provide alternative connection means between the nut 50 and the neck 18, in which case the nut 50 may be better termed a sleeve for retaining the nozzle 36.

While a particular embodiment of the invention has been shown and described, it is clear that many modifications, variations and alterations of the invention will be apparent to those skilled in the art. Therefore, it is intended that such modifications, variations and alternatives be within the spirit and scope of the appended claims.

I claim:

1. A device for dispensing multiple fluid components comprising a body having a plurality of chambers, each having a respective port, said body having a neck, and a nozzle having a base shaped with a generally cylindrical sealing surface to sealingly engage a portion of said neck and a lateral surface to sealingly engage said ports, valve means for non-rotatably moving said base into and out of sealing engagement with said ports, and means for maintaining isolation of said components after said components have moved a substantial distance from said ports into said nozzle.

2. A device according to claim 1 wherein said means for maintaining isolation of said components is a divider formed on said neck and a slot in said nozzle, said divider being shaped to fit into said slot.

3. A device according to claim 2 wherein said device includes closure means for replacing said nozzle when said device is not in use, said closure means having a slot for housing said divider.

4. A device according to claim 1 wherein said device includes closure means for replacing said nozzle when said device is not in use.

5. A device according to claim 1 wherein said device includes a seal disposed about an outer periphery of said neck and an inner periphery of the base of said nozzle.

6. A device according to claim 1 wherein said ports are arcuate in shape, and said base of said nozzle has a pair of surfaces axially movable into positions closing off said ports.

7. A device according to claim 1 wherein said device includes means for restricting relative rotation of said nozzle and said neck.

8. A multi-component dispensing device comprising a body having plurality of chambers, each chamber having a respective port, said body having a neck, a nozzle having a base with a generally cylindrical sealing surface to sealingly engage circumferential portions of said neck and a lateral sealing surface to sealingly engage end portions of said neck, an adjusting nut in axial interference with and rotatable about said nozzle, means for restricting relative rotation of said nozzle and said neck while allowing relative axial movement thereof.

9. A device according to claim 8 wherein said means for preventing rotation is a divider formed on said neck and a slot in said nozzle, said divider being shaped to fit into said slot.

10. A device according to claim 9 wherein said device includes closure means for replacing said nozzle when said device is not in use, said closure means having a slot for housing said divider.

11. A device according to claim 8 wherein said device includes closure means for replacing said nozzle when said device is not in use.

12. A device according to claim 8 wherein said device includes an O-ring disposed about said neck, said O-ring sealing engaging said neck and said nozzle.

13. A device according to claim 8 wherein said ports are arcuate in cross-section, and said base of said nozzle has a pair of surfaces axially movable into positions closing off said ports.

14. A device according to claim 8 wherein said device includes separation means for maintaining isolation of components after said components have moved a substantial distance away from said ports into said nozzle.

15. A device for dispensing multiple fluid components comprising a body having a plurality of chambers, each having a respective port, said body having a neck and a nozzle with a base shaped to sealingly engage a portion of said neck, an adjusting nut in axial interference with and rotatable about said nozzle, and means for preventing relative rotation of said neck, an adjusting nut in axial interference with and rotatable about said nozzle, and means for maintaining isolation of said components after said components have moved a substantial distance from said ports into said nozzle.

16. A device according to claim 15 wherein said means for preventing relative rotation of said neck and nozzle and said means for maintaining isolation of said components comprises mating formations on said neck and nozzle, said formations allowing relative axial movement of said neck and nozzle.

17. A device according to claim 16 wherein said formations comprise a divider formed on said neck and a slot formed in said nozzle.

18. A device according to claim 17 wherein said device includes a closure shaped to replace said nozzle when said device is not in use, said closure having a slot for receiving said divider, said closure having a plurality of projections shaped to match said ports upon installation of said closure on said device.

19. A device according to claim 15 wherein said neck has external threads and said adjusting nut has internal threads which threadingly engage said neck, and said base of said nozzle having at least one rib which snaps into engagement with said nut, said nut being rotatable about said neck to cause rotationless axial movement of said nozzle, said nozzle being movable to first position in which a portion of said base substantially closes off said ports and to a second position in which said components can freely flow through said ports and through said nozzle.

20. A device according to claim 15 wherein said nozzle has three separate sealing surfaces formed on inner portions of said base, a first sealing surface axially disposed and cylindrical in shape for sealing an interface between said nozzle and said neck when said device is open and when said device is closed, and a pair of lateral sealing surfaces for substantially closing off said ports upon movement of said nozzle in the direction of said chambers.

* * * * *